United States Patent [19]

Mousset

[11] 4,261,029

[45] Apr. 7, 1981

[54] LIGHTING DEVICE WITH ROTATABLE REFLECTOR

[75] Inventor: Noël Mousset, Les Andelys, France

[73] Assignee: Holophane S.A., Paris, France

[21] Appl. No.: 9,298

[22] Filed: Feb. 5, 1979

[30] Foreign Application Priority Data

Feb. 9, 1978 [FR] France ..... 78 03697

[51] Int. Cl.[3] ..... F21V 7/09

[52] U.S. Cl. ..... 362/283; 362/287; 362/297; 362/346

[58] Field of Search ..... 362/35, 269, 271, 283, 362/285, 287, 296, 297, 322, 323, 324, 346, 347, 350, 359, 363, 418, 427, 806, 809, 811, 282

[56] References Cited

U.S. PATENT DOCUMENTS 4,091,369 5/1978 Edelbock ..... 362/35

FOREIGN PATENT DOCUMENTS 27919 9/1924 France ..... 362/35
845261 8/1939 France ..... 362/35
851070 1/1940 France ..... 362/35
56359 12/1943 Netherlands ..... 362/35

*Primary Examiner*—Donald A. Griffin
*Assistant Examiner*—Alan Mathews
*Attorney, Agent, or Firm*—DeLio and Montgomery

[57] ABSTRACT

A lighting device with rotating reflector in which the lamp is eccentric so as to obtain an asymmetrical luminous flux.

The said device comprises a main reflector 1, a lamp 7 which is eccentric with respect to the reflector 1 and an additional convex-cylindrical reflector 4 mounted perpendicularly to the plane crossing the rotating axis of the reflector 1 and crossing the lamp 7, a further reflector 11 extending from the reflector 1 on the lamp side.

5 Claims, 2 Drawing Figures

LIGHTING DEVICE WITH ROTATABLE REFLECTOR

Reflectors formed as surface of revolution are already known and used in lighting systems and particularly in street lighting.

Said reflectors make it possible to obtain either a symmetrical beam if the lamp is placed on the axis of revolution, of the reflector, or an asymmetrical distribution of light if the lamp is shifted with respect to the said axis.

When the lamp is placed at a distance from the axis which is equal to half the radius of the section of reflector passing through the lamp and perpendicular to the axis, then a maximal concentration of light is obtained in the direction opposite the shifting of the lamp with respect to the axis of revolution.

In this case, part of the reflector works as a paraboloid whose focus corresponds to the lamp. This arrangement permits a lighting in depth.

The shifting of the lamp leads to the formation of an enlarged virtual image of the lamp, by the portion of reflector which is closest to the lamp visible in a reduced field, whereas the opposite part of the reflector gives a smaller virtual image emitted oppositely to the enlarged image and in a large field.

As a result, the light dispersed this way reaches surfaces located at the rear of the lighting system which are not meant to be lit.

The object of the invention is to reflect that unwanted light in the same direction as that obtained and concentrated by the effect of the shifting of the light, thereby increasing the use factor of the light towards the front.

The object of the invention therefore is a lighting device with a main reflector of revolution in which the lamp is eccentric with respect to the axis of revolution of the reflector, wherein the reflector comprises, on the inside, a support member which can be rotated about the axis of revolution of the main reflector, said support member comprising, diametrically opposed with respect to its rotating axis, first a support for a lamp socket, and second, a support arm for a convex cylindrical reflector of generatrices perpendicular to the diametrical plane passing through the socket support and the support arm.

Figure 1:
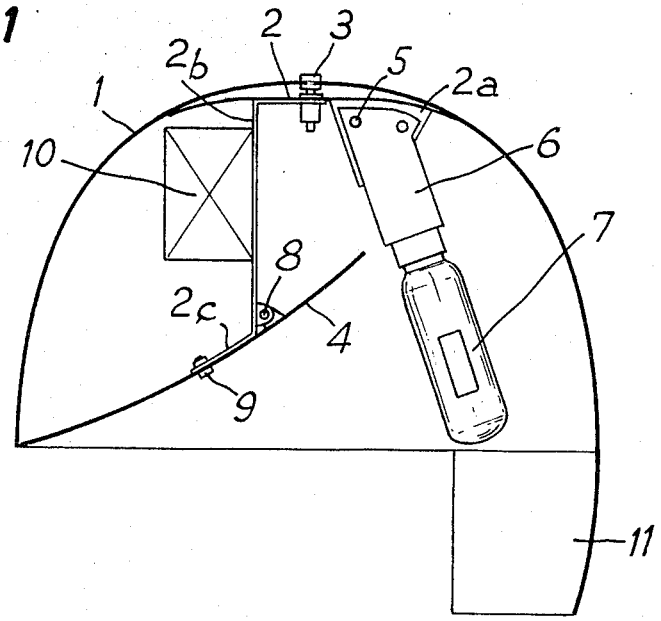
Figure 2:
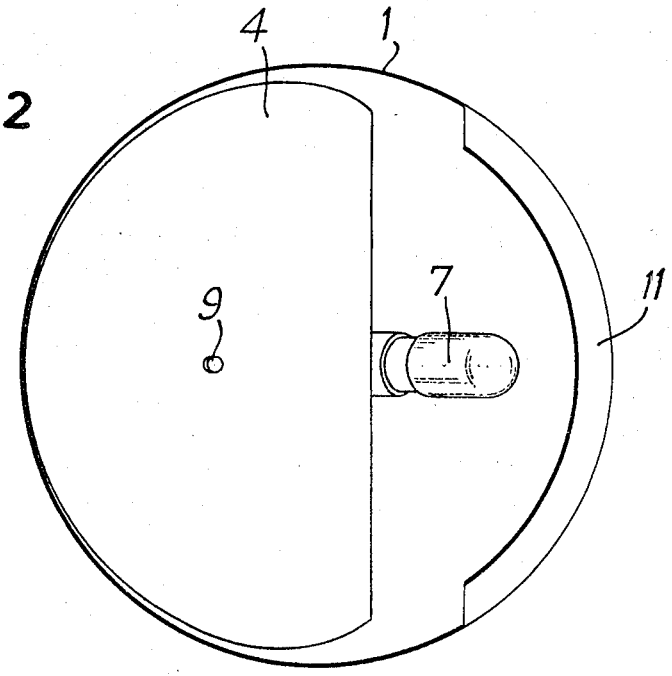

Other characteristics of the invention will become evident on reading the following description, given only by way of example and non-restrictively, reference being made to the accompanying drawings in which:

FIG. 1 shows an axial cross-section of a lighting device according to the invention, FIG. 2 shows the said device from underneath.

According to the invention, the lighting device comprises a reflector of revolution 1, inside which is mounted a support member 2 on a pivot pin 3 placed axially of the reflector, said latter permitting to direct the support by pivoting it about the axis of rotation of the reflector.

Said support 2 comprises, in an axial plane, corresponding to the cross-sectional plane of FIG. 1, and diametrically opposed to one another, first a support 2*a* for the socket 6 and second, an arm support 2*b* on which is mounted a second reflector 4.

The socket support 2*a* can move in the axial plane due to a hinged connection, about an axis 5 placed perpendicularly to the axial plane wherein is placed the support 2. Thus, it is possible to direct the socket 6 in that plane in order to bring the lamp 7 closer to or away from the reflector 1.

The support arm 2*b* is provided with an axis 8 which is perpendicular to the cross-sectional plane. The reflector 4 pivots about the said axis 8 and is fixed to the support 2*c* in position of use by the screw 9. The second reflector 4 is a convex cylindrical reflector of which the generatrices are perpendicular to the axial plane of the support and thus parallel to the pivoting axis 8 of said reflector.

On the support arm 2*b* are mounted the supply auxiliaries 10 which are accessible, as well as the orientation pin 3, when the reflector 4 is brought to a substantially vertical position by pivoting it about the axis 8.

In order to limit the rearward emission of direct luminous flux, a an auxiliary reflector 11 may be used extending from the reflector 1. Said reflector 11, which is directional, is a portion of the reflector of revolution having the same axis as the main reflector, and having the cross-sectional plane of FIG. 1 as its plane of symmetry.

The invention is not limited to the embodiments shown and described in detail, and various modifications may be made thereto without departing from its scope.

I claim:

1. A lighting device comprising-a main concave reflector formed as a surface of revolution around a vertical axis, a support mounted inside said main reflector for rotation about said axis, the support comprising a lamp socket for a lamp which is eccentric with respect to said axis, whereby a maximal concentration of light is obtained in the direction opposite the eccentricity of the lamp with respect to said axis, and a support arm diametrically opposed to said socket with said support arm and said lamp socket being in a vertical diametrical plane including said axis, a second reflector of generally convex cylindrical shape and whose generatrices are perpendicular to said vertical diametrical plane, said second reflector being adapted for rotation with the lamp about said axis and for reflecting the light toward the direction of maximal concentration of light.

2. A lighting device as claimed in claim 1, wherein said lamp socket is mounted for movement within said vertical diametrical plane.

3. A lighting device as claimed in claim 2, wherein said lamp socket is mounted for movement on an axis perpendicular to said vertical diametrical plane.

4. A lighting device as claimed in any one of claims 1 to 3, wherein the second reflector is mounted for rotation about an axis parallel to its generatrices.

5. A lighting device as claimed in any one of claims 1 to 3, which includes an auxiliary reflector extending from the main reflector, said auxiliary reflector being diametrically opposed to the second reflector.

* * * * *